US007845754B2

(12) United States Patent
Onoe

(10) Patent No.: US 7,845,754 B2
(45) Date of Patent: Dec. 7, 2010

(54) APPARATUS AND METHOD FOR EJECTING LIQUID FOR RECORDING HIGHER RESOLUTION IMAGE

(75) Inventor: Kentaro Onoe, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 663 days.

(21) Appl. No.: 11/890,180

(22) Filed: Aug. 2, 2007

(65) Prior Publication Data

US 2008/0030532 A1 Feb. 7, 2008

(30) Foreign Application Priority Data

Aug. 4, 2006 (JP) ..... 2006-213688

(51) Int. Cl.
*B41J 2/015* (2006.01)

(52) U.S. Cl. ..... 347/20; 347/27; 347/32

(58) Field of Classification Search ..... 347/27, 347/32, 8, 20, 68–72
See application file for complete search history.

(56) References Cited

U.S. PATENT DOCUMENTS 4,978,968 A * 12/1990 Ishikawa et al. ..... 347/217
5,541,630 A * 7/1996 Ema et al. ..... 347/70
6,609,780 B2 * 8/2003 Sugiyama ..... 347/33
6,905,184 B2 * 6/2005 Sayama ..... 347/9
2003/0025755 A1 * 2/2003 Baxter et al. ..... 347/29

FOREIGN PATENT DOCUMENTS

| | | | |
|---|---|---|---|
| JP | 62152756 | * | 7/1987 |
| JP | 2-266943 | | 10/1990 |
| JP | 10-58659 | | 3/1998 |
| JP | 2000-117963 | | 4/2000 |
| JP | 2000-272137 | | 10/2000 |
| JP | 3181938 | | 4/2001 |
| JP | 2001-199074 | | 7/2001 |
| JP | 2001-301147 | | 10/2001 |
| JP | 2001-301202 | | 10/2001 |
| JP | 2003-200576 | | 7/2003 |
| JP | 2004-291578 | | 10/2004 |
| JP | 2005-67164 | | 3/2005 |
| JP | 2005-104039 | | 4/2005 |
| JP | 2006-306099 | | 11/2006 |

* cited by examiner

*Primary Examiner*—Charlie Peng
(74) *Attorney, Agent, or Firm*—Cooper & Dunham LLP

(57) ABSTRACT

A liquid ejecting apparatus includes a recording head, a vibrator, and a controller. The recording head further includes a nozzle and is configured to eject a liquid onto a recording medium through the nozzle. The vibrator is disposed on the recording head and is configured to vibrate the recording head in a direction in which the recording medium is conveyed. The controller is configured to control the vibrator to vibrate the recording head in the direction and to control the recording head to eject the liquid during vibration.

14 Claims, 8 Drawing Sheets

APPARATUS AND METHOD FOR EJECTING LIQUID FOR RECORDING HIGHER RESOLUTION IMAGE

BACKGROUND

1. Technical Field

This disclosure relates generally to liquid ejecting apparatuses and methods, and more specifically, to a liquid ejecting apparatus and method capable of recording a relatively high resolution image.

2. Discussion of Related Art

Liquid ejecting apparatuses include apparatuses for recording information by ejecting ink, such as a printer, a plotter, a copying machine, a facsimile machine, and a multi-function device thereof. Liquid ejecting apparatuses also include apparatuses for recording information by ejecting a liquid other than ink, such as a reagent, a DNA sample, and a resist pattern material.

For such liquid ejecting apparatuses, various methods of recording information, such as using images, characters, and patterns, have been proposed. In particular, because of its simple mechanics and advantages it provides in the size and cost reduction, an inkjet recording method is widely used in liquid ejecting apparatuses, for example inkjet printers and inkjet plotters. In the inkjet recording method, a recording head of a liquid ejecting apparatus ejects ink droplets onto a recording medium while scanning the recording medium.

Such inkjet recording method has been used to print a color photographic image, enhancing the resolution of the image thus obtained. Further, the inkjet recording method is used to record or produce an electronic circuit or a liquid crystal panel. In this case, the liquid ejecting apparatus ejects liquid polymer, instead of ink, onto an electronic circuit or a liquid crystal panel.

A liquid ejecting apparatus employing such inkjet recording method (hereinafter, an inkjet recording apparatus) typically records an image on a recording medium as follows: First, an inkjet recording apparatus applies pressure to the ink accommodated in an ink chamber of a recording head by vibration or thermal expansion of a piezoelectric element. Then, through ejection nozzles, the recording head ejects the ink as droplets onto the recording medium. Thus, the ink droplets on the recording medium may form a dot pattern to record a desired image.

An example of such an inkjet recording apparatus is an inkjet recording apparatus of a serial scan type. An inkjet recording apparatus of this type is provided with a recording head including a plurality of ink ejection nozzles. In the recording head, the plurality of nozzles is arranged in a sub-scanning direction, that is, a direction in which a recording medium is conveyed. The serial-scan inkjet recording apparatus ejects ink droplets through the nozzles onto the recording medium while moving the recording head in a main scanning direction perpendicular to the sub-scanning direction.

While moving the recording head from one end to the other end in the main scanning direction, the serial-scan inkjet recording apparatus records an image having a length corresponding to that of the recording head in the sub-scanning direction. After the recording medium is fed by a certain amount (e.g. one line image), the serial-scan inkjet recording apparatus records an image of another line on the recording medium in a manner similar to that described above.

Another example of an inkjet recording apparatus is a line-type inkjet recording apparatus. A line-type inkjet recording apparatus includes a line-type recording head. The line-type recording head has a length corresponding to a full length of a main scanning area thereof. While feeding a recording medium in the main scanning direction, the line-type inkjet recording apparatus ejects ink droplets from the line-type recording head onto the recording medium to form a desired image.

For such inkjet recording apparatuses, a high quality image may be obtained by increasing the resolution of the image. In general, the resolution of an image is expressed in units of dots-per-inch (dpi). Dpi indicates the number of ink droplets per inch, ejected onto a recording medium. The larger the dpi value, the higher the resolution of the image.

For example, to obtain an image with a resolution of 600 dpi, a recording head having 600 nozzles per inch is typically needed. Further, to obtain an image with a higher resolution, the number of nozzles arrayed per inch in the recording head should be increased. Furthermore, such increase of the number of nozzles may necessitate a change in configuration of the ink chamber or an ink supply passage.

Such an increase in the number of nozzles per inch of a recording head is first considered as a way to obtain a high resolution image with an inkjet recording apparatus. Such an increase in the number of nozzles may be achieved by reducing the internal diameter of each nozzle. However, there is a limit to such reduction of the internal diameter of the nozzle due to technical constraints in manufacturing the nozzle. Further, even if the internal diameter of the nozzle is reduced to a certain size, the nozzle might get clogged during an image recording operation by paper dust, for example.

Alternatively, when the nozzle size is reduced, ink chambers communicating with respective nozzles and piezoelectric elements mounted thereon may also need to be arranged at relatively high density. Such high-density arrangement may be difficult to achieve due to constraints imposed by the size of the recording head and/or technical limitations in fabricating a nozzle or ink chamber. Further, use of such fine processing technologies may cause a reduction of yield in manufacturing.

BRIEF SUMMARY

In an aspect of this disclosure, there are provided a liquid ejecting apparatus and method capable of recording an image at relatively high resolution without increasing the number of nozzles in the recording head for ejecting a liquid.

In an exemplary embodiment of the present specification, there is provided a liquid ejecting apparatus including a recording head, a vibrator, and a controller. The recording head further includes a nozzle and is configured to eject a liquid onto a recording medium through the nozzle. The vibrator is disposed on the recording head and is configured to vibrate the recording head in a direction in which the recording medium is conveyed. The controller is configured to control the vibrator to vibrate the recording head in the direction and to control the recording head so as to eject the liquid during the vibration.

Additional features and advantages will be more fully apparent from the following detailed description, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
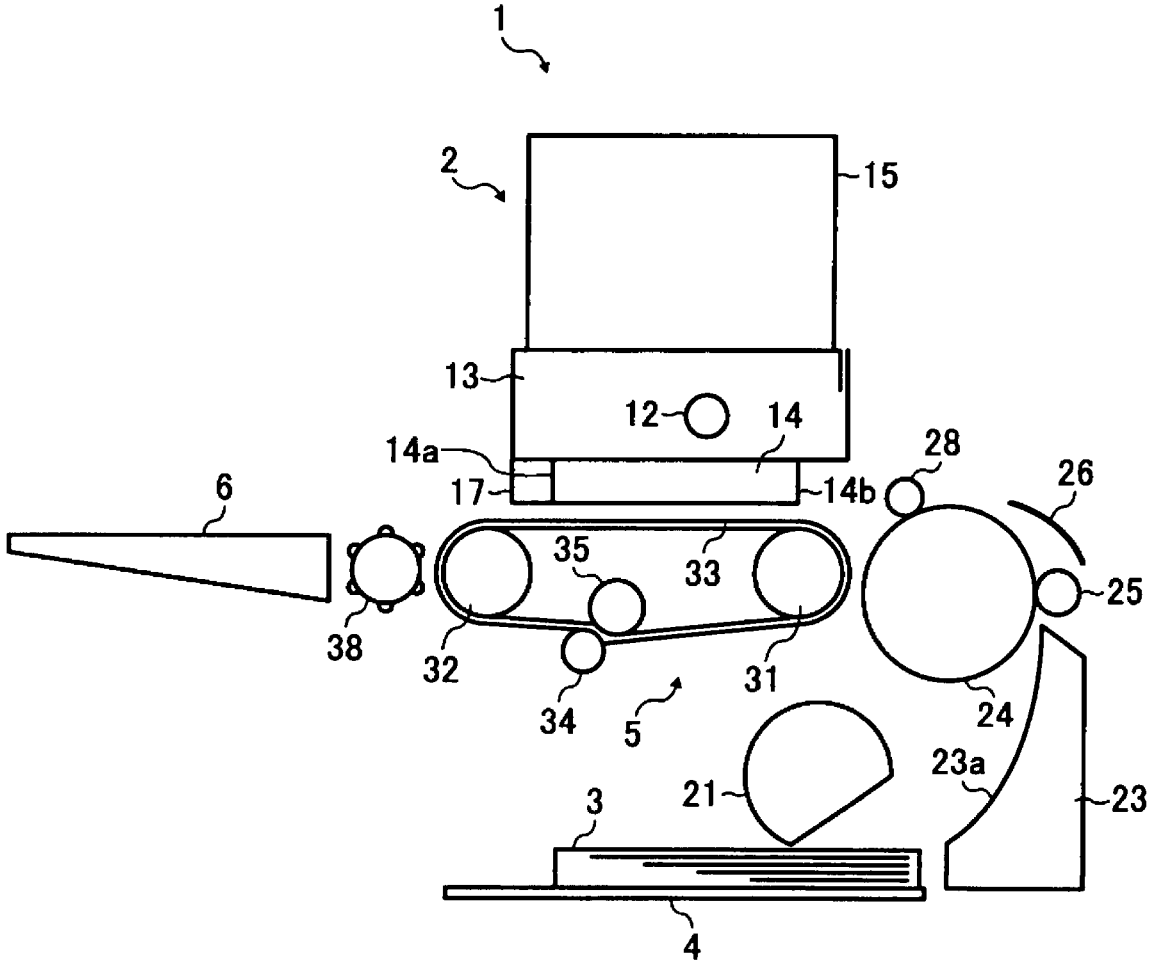
FIG. 1 is a schematic view illustrating one configuration of an inkjet recording apparatus according to an exemplary embodiment of the present invention.

The accompanying drawings are intended to depict exemplary embodiments of the present application and should not be interpreted to limit the scope thereof. The accompanying drawings are not to be considered as drawn to scale unless explicitly noted.

DETAILED DESCRIPTION OF EXEMPLARY EMBODIMENTS

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like may be used herein to facilitate description of one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors herein interpreted accordingly.

Although the terms first, second, etc., may be used herein to describe various elements, components, regions, layers, and/or sections, it should be understood that these elements, components, regions, layers, and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present application.

The terminology used herein is for the purpose of describing particular embodiments only and is not intended to limit the present application. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this application is not intended to be limited to the specific terminology so selected and it is to be understood that each specific element includes all technical equivalents that operate in a similar manner.

Referring now to the drawings, wherein like reference numerals designate identical or corresponding parts throughout the several views, exemplary embodiments are described. It should be noted that the present application is not limited to the exemplary embodiments as illustrated in the drawings.

Hereinafter, exemplary embodiments are described with reference to a serial-scan type inkjet recording apparatus. However, the liquid ejecting apparatus and method according to the present application are also applicable to other types of liquid recording apparatuses including a line-type inkjet recording apparatus.

First, an inkjet recording apparatus according to an exemplary embodiment is described with reference to FIGS. 1 to 4.

Figure 2:
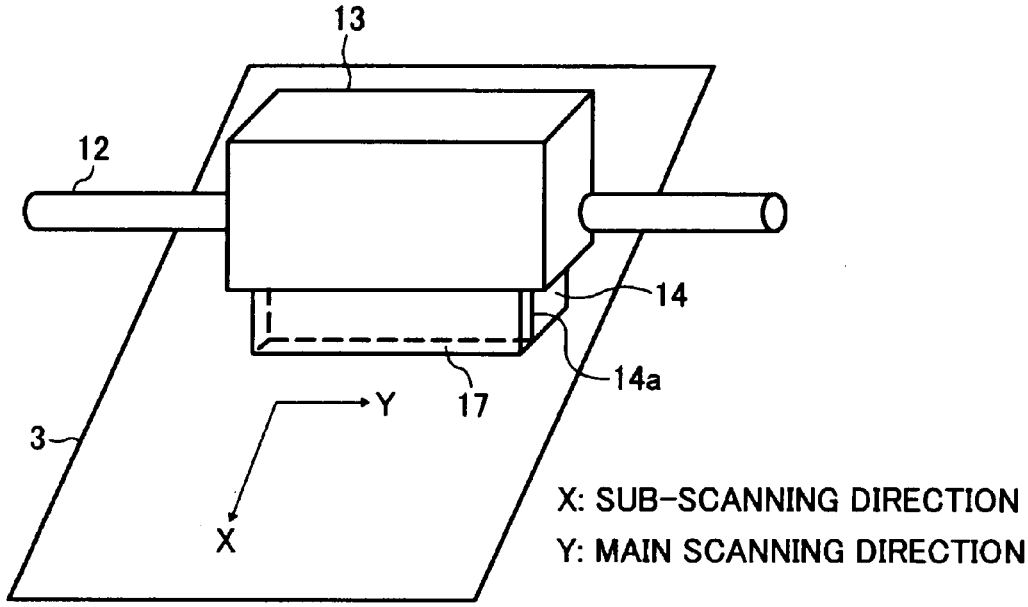
FIG. 2 is a schematic perspective view illustrating a carriage of the inkjet recording apparatus according to the exemplary embodiment, seen obliquely from above.
Figure 3:
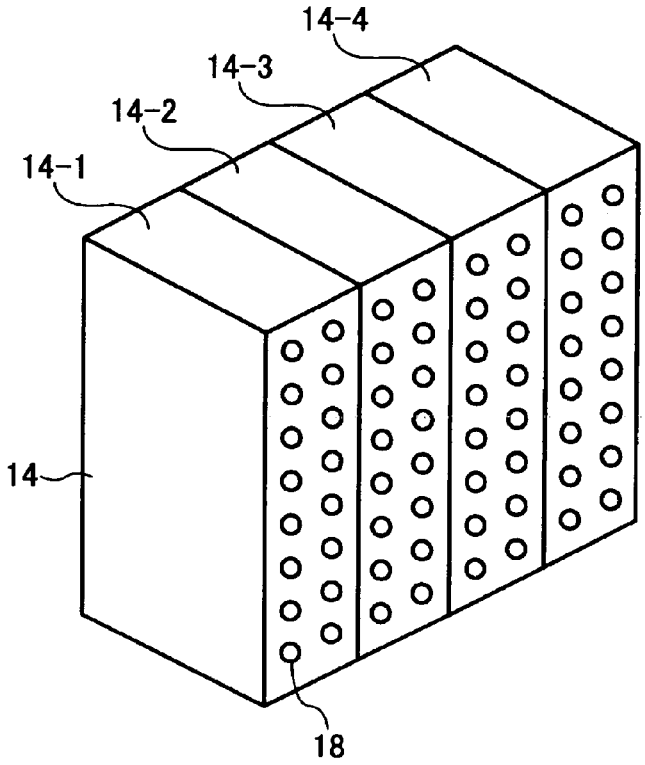
FIG. 3 is a schematic perspective view illustrating one configuration of a recording head used in the inkjet recording apparatus according to the exemplary embodiment, seen obliquely from below.

FIG. 1 is a schematic view illustrating a configuration of an inkjet recording apparatus 1 of the exemplary embodiment. FIG. 2 is a schematic perspective view illustrating a carriage 13 of the inkjet recording apparatus 1, seen obliquely from above. In FIG. 2, a cartridge 15 illustrated in FIG. 1 is omitted for simplicity. FIG. 3 is a schematic view illustrating an example configuration of a recording head unit 14 used in the inkjet recording apparatus 1. FIGS. 4A to 4D schematically illustrate four example configurations of a recording head unit 14 corresponding to ink colors usable in the inkjet recording apparatus 1.

As illustrated in FIG. 1, the inkjet recording apparatus 1 may include an image forming unit 2. The image forming unit 2 may also include a guide shaft 12 and a carriage 13.

As shown in FIG. 2, the guide shaft 12 extending in one direction with a given length may support the carriage 13. The carriage 13 is supported on the guide shaft 12 so as to be slidable along and rotatable around the guide shaft 12.

Below the carriage 13 is disposed a recording head unit 14. As illustrated in FIG. 3, the recording head unit 14 may include four recording heads 14-1, 14-2, 14-3, and 14-4 that eject ink droplets of four colors of black (K), cyan (C), magenta (M), and yellow (Y), respectively. The recording head unit 14 also has multiple nozzles 18 from which ink droplets are ejected.

Alternatively, the recording head unit 14 may be formed by a single recording head that ejects ink droplets of four colors.

As illustrated in FIG. 1, the carriage 13 is provided with a cartridge 15 to supply ink to the recording head unit 14. The cartridge 15 is detachably mounted on the carriage 13.

Alternatively, instead of the cartridge 15, the carriage 13 may be provided with a sub-reservoir. Thus, the carriage 13 is configured so that ink may be supplied from a main reservoir to the sub-reservoir.

In the image forming unit 2, as illustrated in FIG. 2, the recording head unit 14 is moved by a main scanning motor 214, later described, in a main scanning direction Y perpendicular to a sub-scanning direction X in which a recording medium 3 is conveyed.

In FIG. 2, the carriage 13 is schematically illustrated and the cartridge 15 is omitted for simplicity as described above.

As illustrated in FIGS. 1 and 2, a driving element 17 is disposed on a side surface 14*a* of the recording head unit 14, which is disposed parallel to the main scanning direction Y. Alternatively, the driving element 17 may be disposed on a side surface 14*b* of the recording head unit 14, which is disposed opposite to the side surface 14*a*.

The driving element 17 swingingly moves the recording head unit 14 around the guide shaft 12, thus vibrating the nozzles 18 arrayed in the recording head unit 14.

A piezoelectric element, for example, may be used as the driving element 17. Applying voltage to the driving element 17 causes expansion and contraction of the driving element 17.

Expansion of the driving element 17 generates positive pressure against the side surface 14*a* of the recording head unit 14, which is disposed parallel to the main scanning direction Y. Here, positive pressure is pressure that pushes the recording head unit 14 in a sub-scanning direction X in FIG. 2.

On the other hand, contraction of the driving element 17 generates negative pressure against the side surface 14*a* of the recording head unit 14. Here, negative pressure is pressure that pulls the recording head unit 14 in the sub-scanning direction X illustrated in FIG. 2.

Such positive and negative pressures, which are generated by the extension and contraction of the driving element 17, vibrates the recording head unit 14, thus causing the recording head unit 14 to swingingly move around the guide shaft 12 so that the nozzles 18 arrayed in the recording head unit 14 are also vibrated. It should be noted that the driving element 17 is not limited to a piezoelectric element, and may be another member other than the piezoelectric element provided that the member vibrates the recording head unit 14.

When no voltage is applied to the driving element 17, the recording head unit 14 is substantially horizontally positioned relative to a recording surface of the recording medium 3 in FIG. 2.

Figure 4A:
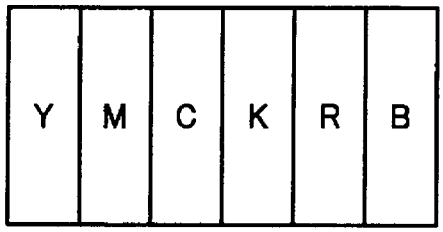
FIGS. 4A to 4D schematically illustrate four configurations of a recording head corresponding to ink colors usable by the inkjet recording apparatus according to the exemplary embodiment.

It should be noted that the number and arrangement of ink colors of the recording head unit 14 are not limited to those described above. For example, the recording head unit 14 may be provided with six recording heads corresponding to six colors including red, R, and blue, B, in addition to the above-described four colors Y, C, M, and K as illustrated in FIG. 4A.

Figure 4B:
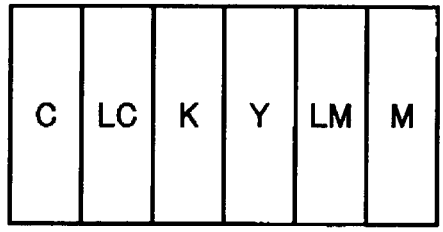
Figure 4C:
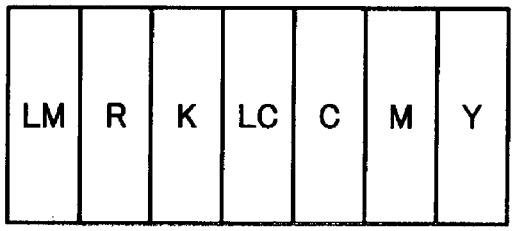
Figure 4D:
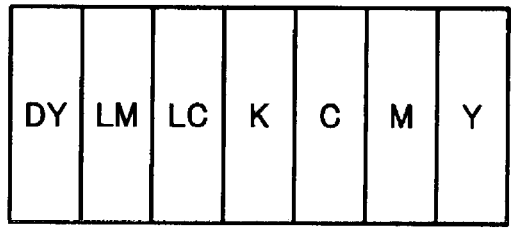

Alternatively, the recording head unit 14 may be provided with six recording heads corresponding to six colors including light cyan, LC, and light magenta, LM, in addition to the above-noted four colors as illustrated in FIG. 4B. Further, the recording head unit 14 may be provided with seven recording heads corresponding to seven colors including, in addition to the six colors of FIG. 4B, red, R, as illustrated in FIG. 4C, or dark yellow, DY, as illustrated in FIG. 4D.

FIG. 3 illustrates the recording head unit 14 including four recording heads corresponding to four colors. However, as described above, the recording head unit 14 may include recording heads corresponding to multiple colors other than four colors.

The recording head unit 14 includes an actuator, not illustrated, that generates energy to eject liquid. The actuator may be, for example, a piezoelectric actuator such as a piezoelectric element. Alternatively, the actuator may be a thermal actuator using a phase change that is caused by film boiling of liquid with an electrothermal conversion element such as a heat-generating resistance element. Further, the actuator may be a shape-memory alloy actuator using a phase change of a metal that is caused by a temperature change, or an electrostatic actuator using an electrostatic force to eject liquid.

As illustrated in FIG. 1, the inkjet recording apparatus 1 is provided at the bottom with a sheet feed tray 4 capable of storing a plurality of recording media 3.

The recording medium 3 may not be limited to a typical recording paper sheet but include other medium, such as an OHP film, onto which droplets of ink or other liquid is ejected. Hereinafter, various kinds of recording media may be simply referred as a "sheet 3" for simplicity.

The inkjet recording apparatus 1 may also include a conveyance section 5. As illustrated in FIG. 1, the conveyance section 5 may include a sheet feed roller 21, pressing rollers 25 and 28, a conveyance guide 23, a guide member 26, a conveyance roller 24, a driving roller 31, a driven roller 32, a charging roller 34, a guide roller 35, an sheet ejection roller 38, and a conveyance belt 33.

The conveyance section 5 conveys the sheet 3, stored in the sheet feed tray 4, beneath the image forming unit 2. Then, the sheet 3 is ejected to a tray 6.

A recording operation of the inkjet recording apparatus 1 is described in greater detail later.

Next, a functional configuration of the inkjet recording apparatus 1 is described with reference to FIG. 5.

Figure 5:
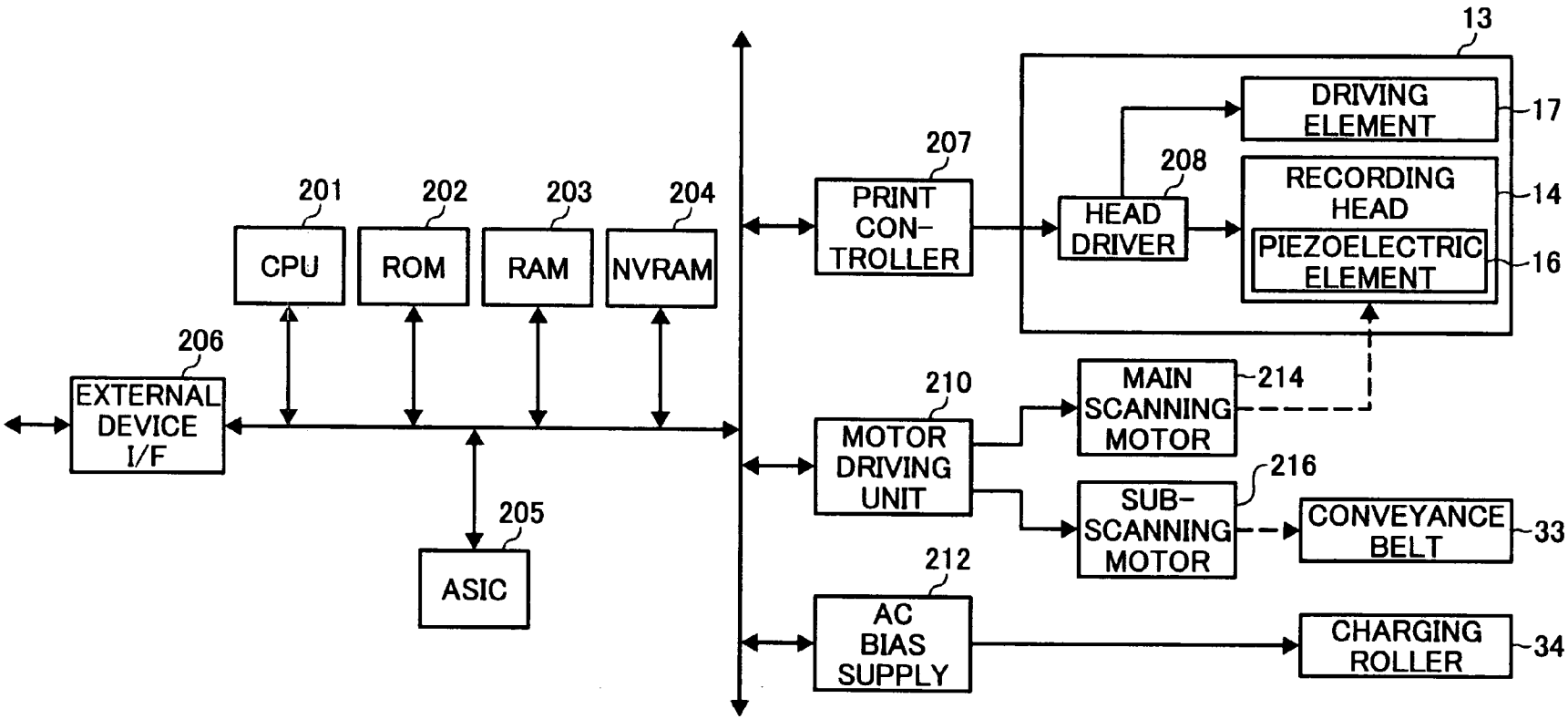
FIG. 5 is a functional block diagram of the inkjet recording apparatus according to the exemplary embodiment.

FIG. 5 is a functional block diagram of the inkjet recording apparatus 1. As illustrated in FIG. 5, the inkjet recording apparatus 1 may include a central processing unit (CPU) 201, a read-only memory (ROM) 202, a random access memory 203 (RAM), a non-volatile random access memory (NVRAM) 204, and an application specific integrated circuit (ASIC) 205.

The CPU 201 controls processing for recording an image. The ROM 202 stores a control program, an emulation program, and font data. The RAM 203 temporarily stores printing data received from an external device as well as image data for recording an image, etc. The NVRAM 204, which is a rewritable memory, stores such data even if the inkjet recording apparatus 1 is powered off.

The ASIC 205 controls access to the RAM 203, communicates data with external devices, and transmits control signals to a motor driver.

The CPU 201 controls the inkjet recording apparatus 1 through the control program stored in the ROM 201. The CPU 201 reads, from an input-and-output (I/O) data register in an external device interface (I/F) 206, information on an emulation command in the printing data. The information is transmitted from an external device to the inkjet recording apparatus 1. The CPU 201 also reads from and writes into an input/output (I/O) register and an input/output (I/O) port in the ASIC 205 the data for executing a control in accordance with the emulation command.

Further, as illustrated in FIG. 5, the inkjet recording apparatus 1 may include a print controller 207, a head driver 208, a motor driving unit 210, an alternating current (AC) bias supply 212, a main scanning motor 214, and a sub-scanning motor 216.

The print controller 207 includes a data transmission unit and a drive signal generation unit capable of driving and controlling the recording head unit 14. The head driver 208, which is a driver integrated circuit, drives the recording head unit 14 mounted on the carriage 13.

The motor driving unit 210 drives the main scanning motor 214 and the sub-scanning motor 216. The AC bias supply supplies an AC bias to the charging roller 34.

The CPU 201 reads and analyzes the printing data, which is written in the data register of the external device I/F 206. Then, the ASIC 205 executes image processing, data sorting, and other appropriate processing, and instructs the print controller 207 to transmit the image data to the head driver 208.

The print controller 207 transmits the image data as serial data to the head driver 208. The print controller 207 also transmits, to the head driver 208, control signals for transmitting the image data and confirming the transmission thereof.

The print controller 207 may also include the drive signal generating unit. The drive signal generating unit may include a direct-current/alternating-current (DC/AC) converter, a voltage amplifier, a current amplifier, etc. The DC/AC converter transforms direct current to alternating current of the pattern data of a drive signal stored in the ROM 202. The print controller 207 outputs a drive signal, including a single drive pulse or multiple drive pulses, to the head driver 208.

To the recording head unit 14 the head driver 208 applies a drive signal "A", described later with reference to FIG. 7, for ejecting an ink droplet. At this time, the head driver 208 applies the drive signal "A" to the recording head unit 14 to eject ink droplets from the nozzles of the recording head unit 14. Such drive signal "A" may be generated based on the image data, which is serially input from the print controller 207 to the recording head unit 14. The image data may correspond to a range in which the nozzles are arranged in the recording head unit 14 in the sub-scanning direction.

As illustrated in FIG. 5, the recording head unit 14 may include a piezoelectric element 16 capable of ejecting ink. The piezoelectric element 16 expands or contracts in response to the drive signal "A", which decreases or increases the volume of a chamber thereof. Such a change in the volume of the chamber generates pressure to eject ink droplets through the nozzles of the recording head unit 14.

The head driver 208 also applies a drive signal "B", described later with reference to FIG. 8, to the driving element 17 to change the orientation of the nozzles of the recording head unit 14. The driving element 17 expands or contracts in response to the drive signal "B" to generate the positive pressure or the negative pressure described above. The positive and negative pressures cause the recording head unit 14 to swingingly move around the guide shaft 12. Thus, the driving element 17 vibrates the recording head unit 14.

With such swing movement of the recording head unit 14, the orientation of the nozzles of the recording head unit 14 is changed so that ink droplets may be ejected to a first area on the sheet 3, which is in a substantially vertical direction from each nozzle toward the sheet 3, and a second area on the sheet 3, which is deviated from the substantially vertical direction. The second area on the sheet 3 may correspond to an interval area between adjacent nozzles of the nozzles arrayed in the recording head unit 14.

The motor driving unit 210 calculates a control value for the main scanning motor 214. The control value is calculated based on a target speed value, transmitted from the CPU 201, and a detected speed value, obtained by sampling a pulse signal detected with an encoder sensor in a linear encoder. Based on the calculation result, the motor driving unit 210 drives the main scanning motor 214 via an internal motor driver.

The motor driving unit 210 also calculates a control value for the sub-scanning motor 216. The control value is calculated based on a target speed value, sent from the CPU 201, and a detected speed value, obtained by sampling a detected pulse signal detected with the encoder sensor. Based on the calculation result, the motor driving unit 210 drives the sub-scanning motor 216 via an internal motor driver.

Next, a recording operation of the inkjet recording apparatus 1 is described with reference to FIGS. 6 to 9, in addition to FIGS. 1 and 5 described above.

Figure 6:
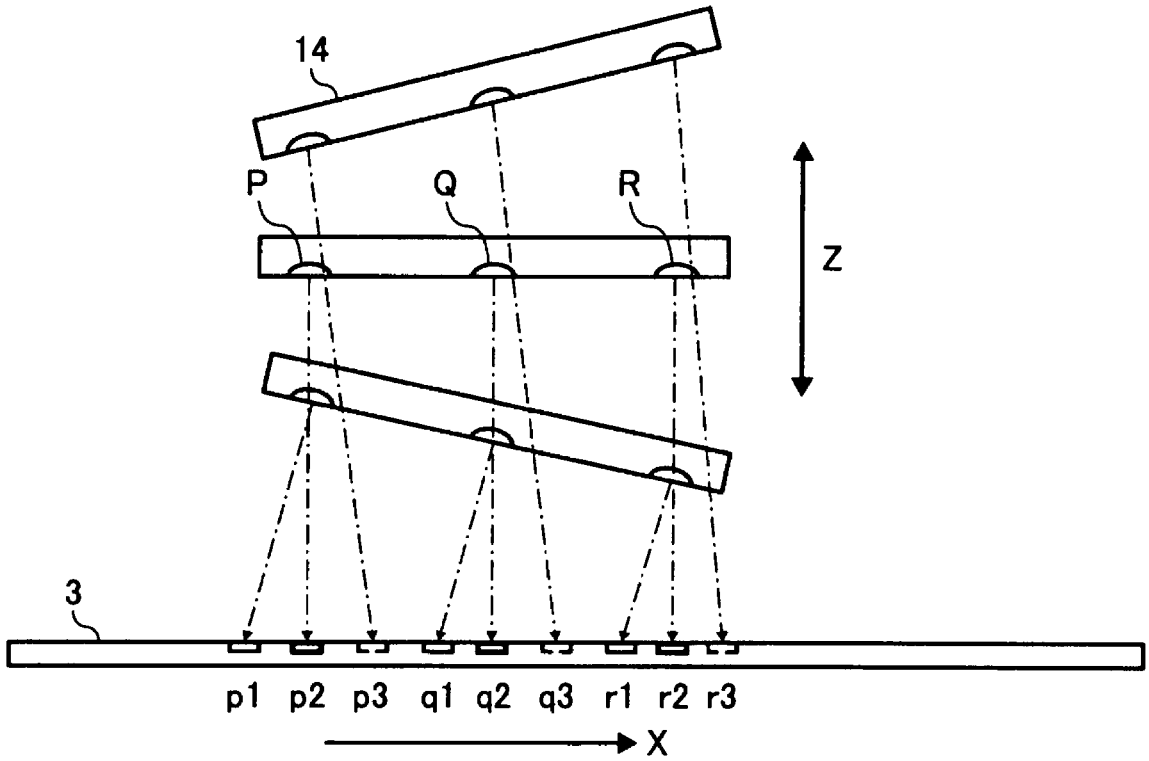
FIG. 6 is a diagram illustrating a movement of a recording head of the inkjet recording apparatus and ink ejecting directions from the recording head according to the exemplary embodiment.

FIG. 6 schematically illustrates a movement of the recording head unit 14 of the inkjet recording apparatus 1 and directions in which ink droplets are ejected from the recording head unit 14. FIG. 7 is a timing chart illustrating drive signals generated in the inkjet recording apparatus 1. FIG. 8 is a schematic diagram illustrating an example of ejection result of ink droplets by a conventional inkjet recording apparatus. On the other hand, FIG. 9 is a schematic diagram illustrating an ejection result of ink droplets by the inkjet recording apparatus 1 according to the exemplary embodiment.

In the inkjet recording apparatus 1 illustrated in FIG. 1, the sheet 3, stored in the sheet feed tray 4, is separated one by one by the sheet feed roller 21 and a separation pad, not illustrated. Then, the sheet 3 is fed to the conveyance section 5. In the conveyance section 5, the sheet 3 is upwardly guided along a guide surface 23*a* of the conveyance guide 23.

The sheet 3 is sandwiched between the conveyance roller 24 and the pressing roller 25. At this time, the pressing roller 25 presses the sheet 3 against the conveyance roller 24. Then, the sheet 3 is sent out by the rotation of the conveyance roller 24 and the pressing roller 25. The sheet 3 is guided toward the conveyance roller 24 by the guide member 26.

Further, the sheet 3 is sandwiched between the conveyance roller 24 and the pressing roller 28. The pressing roller 28 presses the sheet 3 against the conveyance roller 24. Then, the sheet 3 is conveyed beneath the image forming unit 2 of FIG. 1 by the rotation of the conveyance roller 24 and the pressing roller 28.

The sheet 3 is conveyed to the conveyance belt 33, which is extended over the driving roller 31 and the driven roller 32. Near the conveyance belt 33 are disposed the charging roller 34, the guide roller 35, and a guide plate, not illustrated.

The charging roller 34 charges the conveyance belt 33. The guide roller 35 is disposed to face the charging roller 34 by sandwiching the conveyance belt 33 therebetween. The guide plate, not illustrated, guides the conveyance belt 33 at a position facing the image forming unit 2.

Further, near the conveyance belt 33 may be disposed a cleaning roller, made of a porous material, to clean droplets remaining on the outer surface of the conveyance belt 33.

The charging roller 34 is disposed to contact the outer surface of the conveyance belt 33, and is rotationally driven by the rotation of the conveyance belt 33. The charging roller 34 is applied with relatively high voltage by a high-voltage circuit so as to have a certain charging pattern.

The conveyance belt 33 travels in a counterclockwise direction in FIG. 1 while contacting the charging roller 34. Therefore, when the charging roller 34 is applied with relatively high voltage as described above, the conveyance belt 33 is positively charged by the charging roller 34. In this case, the conveyance belt 33 is charged in a certain charging pattern by switching between positive and negative polarities of the charging roller 34 in a certain time interval.

In this state, when the sheet 3 is fed to the conveyance belt 33 being charged with a high potential, the sheet 3 is electrically polarized. Electric charges having a polarity opposite to a polarity of electric charges on the conveyance belt 33 are inducted to an interface of the sheet 3 with the conveyance belt 33.

Then, the electric charges on the conveyance belt 33 and the electric charges inducted to the interface of the sheet 3 are electrostatically attracted to each other. Thus, the sheet 3 is strongly attracted to the conveyance belt 33, thereby suppressing curling or unevenness of the sheet 3. As a result, a relatively highly flat surface may be obtained for the sheet 3.

Further, the inkjet recording apparatus 1 drives the recording head unit 14 in response to drive signals based on the image data while circulating the conveyance belt 33 to convey the sheet 3. When the sheet 3 is temporarily stopped, the recording head unit 14 ejects ink droplets onto the sheet 3. Thus, with one scanning operation, the inkjet recording apparatus 1 records an image having a width corresponding to a range in which the nozzles are arranged in the recording head unit 14 in the sub-scanning direction X.

Next, a method of controlling ejection of ink droplets onto the sheet 3 is described for the inkjet recording apparatus 1 according to the present exemplary embodiment.

As illustrated in FIG. 5, when the head driver 208 applies the drive signal "A" to the recording head unit 14, the voltage of the recording head unit 14 is changed. The change in voltage causes the liquid-ejecting piezoelectric element 16 of the recording head unit 14 to expand or contract, thereby decreasing or increasing the volume of the chamber of the recording head unit 14. Such a change in the volume of the chamber generates pressure to eject ink droplets from the chamber through the nozzles. At this time, the driving element 17 receives, from the head driver 208, the drive signal "B" for vibrating the recording head unit 14 to change the orientation of the nozzles relative to the sheet 3.

As illustrated in FIG. 2, the driving element 17 is disposed on a side surface 14*a* of the recording head unit 14 parallel to the main scanning direction Y thereof. However, the driving element 14 does not necessarily need to be disposed on the side surface 14*a*, which is provided parallel to the main scanning direction Y. Provided that the driving element 14 vibrates the recording head unit 14 to change the orientation of the nozzles relative to the sheet 3, the driving element 14 may be disposed at another position such as the side surface 14*b* of FIG. 1.

When receiving the drive signal "B", the driving element 17 is deformed by a change in voltage caused by the drive signal "B". At this time, the driving element 17 is deformed to expand or contract in a substantially horizontal direction in FIG. 1 or FIG. 6.

However, provided that the driving element 17 vibrates the recording head unit 14 to change the orientation of the nozzles relative to the sheet 3, the direction in which the driving element 17 expands or contracts is not limited to the substantially horizontal direction, but may be another direction, for example, a substantially vertical direction "Z" illustrated in FIG. 6.

Thus, as illustrated in FIG. 6, the recording head unit 14 ejects ink droplets onto the sheet 3 while vibrating in directions different from the main scanning direction Y.

For example, as shown in FIG. 6, the recording head unit 14 sequentially ejects ink droplets p1, p2, p3 from a nozzle "P" onto the sheet 3 corresponding to the vibration of the recording head unit 14. Similarly, the recording head unit 14 ejects ink droplets q1, q2, q3 from a nozzle "Q" and ink droplets r1, r2, r3 from a nozzle "R".

It should be noted that in FIG. 6 the recording head unit 14 is illustrated schematically in simplified terms so that the vibration thereof may be easily understood.

Next, the drive signals "A" and "B" applied from the head driver 208 to the driving element 17 are described in greater detail with reference to FIG. 7.

The head driver 208 applies a drive signal "B" to the driving element 17 at a time "t1". The application of the drive signal "B" causes a change in voltage, that is, a charging of the driving element 17, which expands the driving element 17. Therefore, the recording head unit 14, on which the driving element 17 is disposed, is moved in the sub-scanning direction X in FIG. 6 in response to the expansion of the driving element 17.

Figure 7:
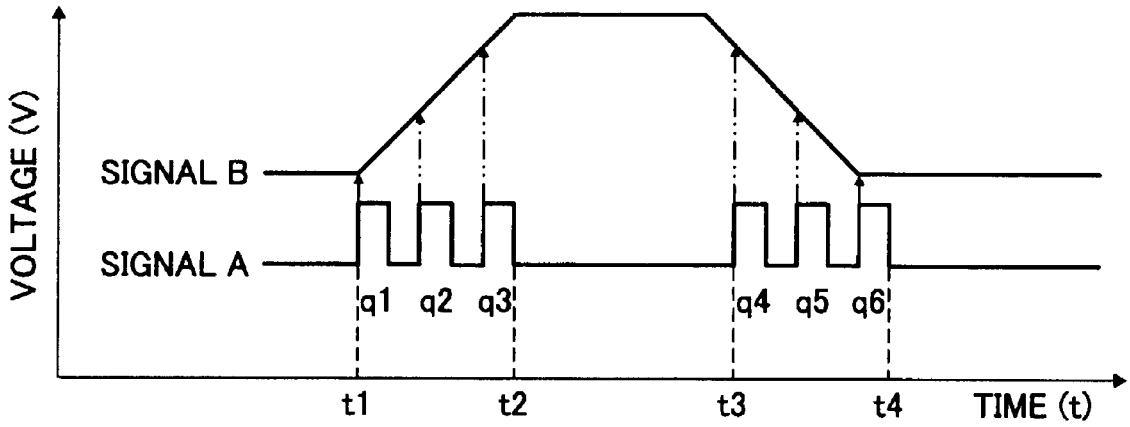
FIG. 7 is a timing chart illustrating drive signals generated in the inkjet recording apparatus according to the exemplary embodiment.

During this movement, the head driver 208 applies the drive signal "A" to the recording head unit 14, for example, three times as illustrated in FIG. 7. Each application of the drive signal "A" causes a change in voltage, that is, a charge and discharge of the recording head unit 14.

In response to such voltage change, the recording head unit 14 drives the liquid-ejecting piezoelectric element 16 to change the volume of the chamber thereof. Thus, the recording head unit 14 ejects multiple ink droplets by a time "t2" at which the change or charging of the drive signal "B" ends.

Then, at a time "t3", the head driver 208 applies the drive signal "B" to the driving element 17 again. The application of the drive signal "B" causes a change in voltage, that is, a discharge of the driving element 17, which contracts the driving element 17. Thereby, the recording head unit 14, on which the driving element 17 is disposed, is moved back in a direction opposite to the sub-scanning direction X.

During this movement, the head driver 208 applies the drive signal "A" to the recording head unit 14, for example, three times as illustrated in FIG. 7. Each application of the drive signal "A" causes a change in voltage, that is, a charge and discharge of the recording head unit 14. In response to such voltage change, the recording head unit 14 drives the liquid-ejecting piezoelectric element 16 to change the volume of the chamber thereof. Thus, the recording head unit 14 ejects multiple ink droplets by a time "t4" at which the application of the drive signal "B" ends.

In FIG. 7, the drive signal "A" is applied based on the application and change of the drive signal "B", thereby causing the recording head unit 14 to eject ink droplets while being reciprocatingly vibrated in the sub-scanning direction X.

Next, the ejection result of the inkjet recording apparatus 1 according to the present exemplary embodiment is compared with that of a conventional inkjet recording apparatus.

Figure 8:
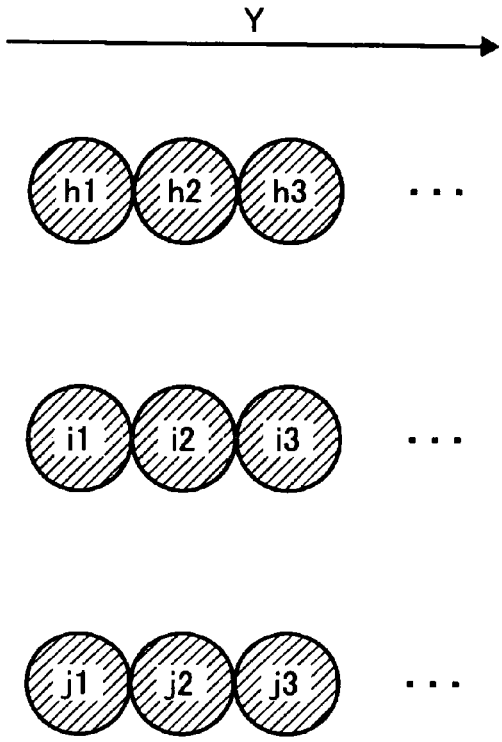
FIG. 8 is a schematic diagram illustrating an example of ejection result of ink droplets by a conventional inkjet recording apparatus.
Figure 9:
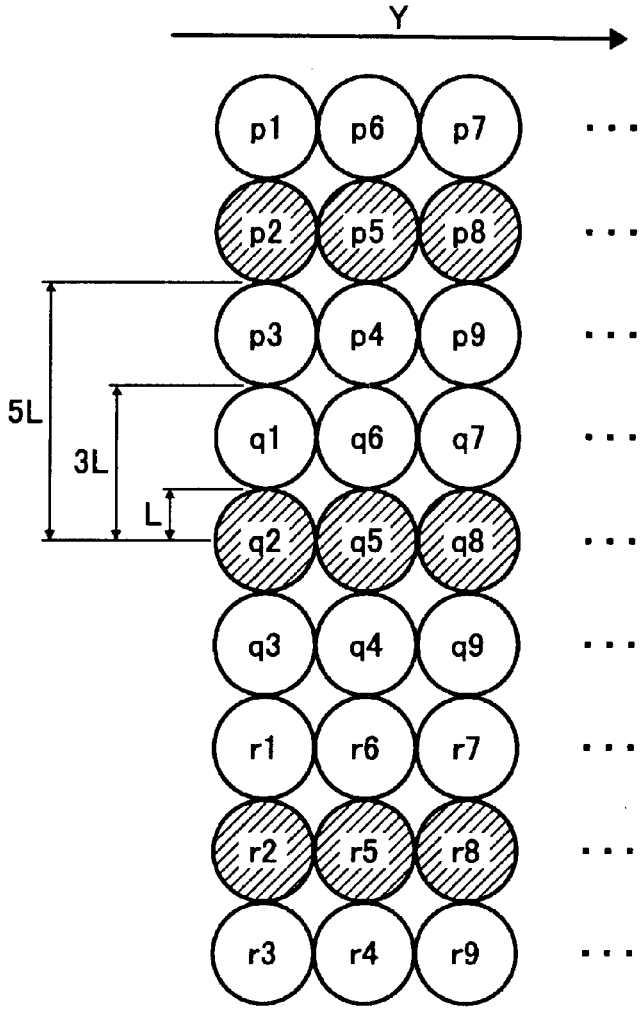
FIG. 9 is a schematic diagram illustrating one ejection result of ink droplets by the inkjet recording apparatus according to the exemplary embodiment.

FIG. 8 illustrates an example of ejection result by an inkjet recording apparatus employing a conventional recording head. On the other hand, FIG. 9 illustrates an example of ejection result by the inkjet recording apparatus 1 according to the present exemplary embodiment. Here, the conventional inkjet recording apparatus is similar, if not identical, to the inkjet recording apparatus 1 according to the present exemplary embodiment in the arrangement of nozzles of the recording head.

FIG. 8 illustrates ink droplets having been ejected from nozzles "H", "I", "J" among the nozzles which are arranged in the sub-scanning direction of the conventional inkjet recording apparatus. For example, the conventional recording head sequentially ejects ink droplets h1, h2, h3 from the nozzle "H". Similarly, the conventional inkjet recording apparatus sequentially ejects ink droplets i1, i2, i3 from the nozzle "I" and ink droplets j1, j2, j3 from the nozzle "J", respectively.

In the inkjet recording apparatus 1, the recording head unit 14 is vibrated in the sub-scanning direction X perpendicular to the main scanning direction Y, thereby, as illustrated in FIG. 9, causing the recording head unit 14 sequentially to eject ink droplets p1, p2, p3 around a conventional landing position of the ink droplet h1 indicated by hatching in FIG. 9.

Similarly, the recording head unit 14 sequentially ejects ink droplets q1, q2, q3 around a conventional landing position of the ink droplet i1, and ink droplets r1, r2, r3 around a conventional landing position of the ink droplet j1, indicated by hatching in FIG. 9.

It should be noted that although in the foregoing description only the three nozzles P, Q, R are referred to as the nozzles of the recording head unit 14, the number of nozzles of the recording head unit 14 is not limited to three but may be more than three or may be less than three.

As described above with reference to FIG. 8, in one scanning operation, a conventional inkjet recording apparatus ejects only one droplet per nozzle, such as h1, i1, and j1, in the sub-scanning direction X, i.e., a direction in which the nozzles are arranged.

On the other hand, the above-described configuration of the recording head unit 14 of the present exemplary embodiment allows a greater number of ink droplets to be ejected. Accordingly, without increasing the number of nozzles, the ink droplets may be applied onto a sheet at a relatively high density, thereby enabling the inkjet recording apparatus 1 to provide a relatively high-resolution image.

As described above, in FIG. 7, three droplets of ink are ejected from the time "t1" to the time "t2". However, it should be noted that such number of droplets to be ejected is not limited to three but may be set to any given number. Further, such ink droplets may be ejected at a given timing as long as the nozzles of the recording head unit 14 are being vibrated.

Thus, the image having a width corresponding to a range in which the nozzles are arranged along the sub-scanning direction is recorded on the sheet 3. Then, the sheet 3 is conveyed by a certain amount with the conveyance belt 33. The subsequent recording operation is started and executed in a manner similar to that described above.

When receiving a recording end signal or a signal indicating that the rear end of the sheet 3 reaches a recording area of the recording head unit 14, the recording operation of the image is finished. The sheet 3, having the image recorded thereon, is output to the output tray 6 by the rotation of the ejection roller 38.

Furthermore, when the recording head unit 14 is vibrated to change the orientation of the nozzles, the recording head unit 14 may be controlled so as to eject ink droplets through each nozzle in a given range on the sheet 3 other than the above-described range. At this time, the inkjet recording apparatus 1 may determine the range based on an interval between the nozzles arrayed in the recording head unit 14. Thus, the recording head unit 14 may eject a greater number of ink droplets onto an area on the sheet 3, which is deviated from the substantially vertical direction from each nozzle toward the sheet 3. The area on the sheet 3 corresponds to the interval between the nozzles arrayed in the recording head unit 14.

Here, take an ink droplet q2 illustrated in FIG. 9 as an example. The recording head unit 14 may be controlled so as to eject an ink droplet q2 at a point intermediate between central points of ink droplets p2 and r2 in FIG. 9. The ink droplets p2 and r2 correspond to the conventional landing positions h1 and j1, respectively, illustrated in FIG. 8.

In the foregoing description of FIG. 9, when "L" represents the radius of ink droplet, the recording head unit 14 is controlled so as to eject ink droplets through each nozzle in a range with a length of 3L from the central point of the ink droplet q2 in each of upward and downward directions perpendicular to the main scanning direction Y.

Alternatively, the recording head unit 14 may be controlled so as to eject ink droplets through each nozzle in a range with a length of 5L from the central point of the ink droplet q2 in each of the upward and downward directions. As a result, without increasing the number of nozzles the recording head unit 14 may apply ink droplets onto a sheet at a relatively high density, thereby enabling the inkjet recording apparatus 1 to provide a relatively high-resolution image.

The liquid ejecting apparatus and method of the present application are applicable not only to inkjet recording apparatuses as described above but to other uses and purposes such as the recording or manufacturing of an electronic circuit or a liquid crystal panel using a liquid polymer, etc.

Figure 10:
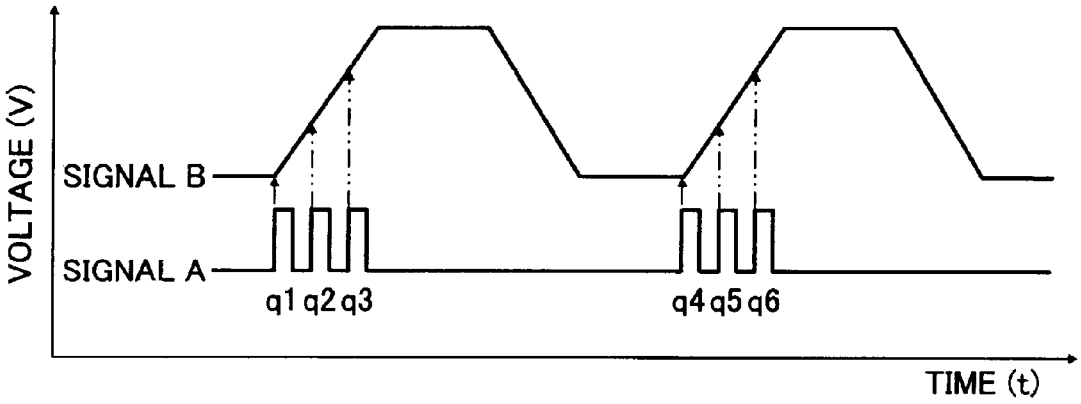
FIG. 10 is a timing chart illustrating drive signals generated in the inkjet recording apparatus according to another exemplary embodiment of the present invention.
Figure 11:
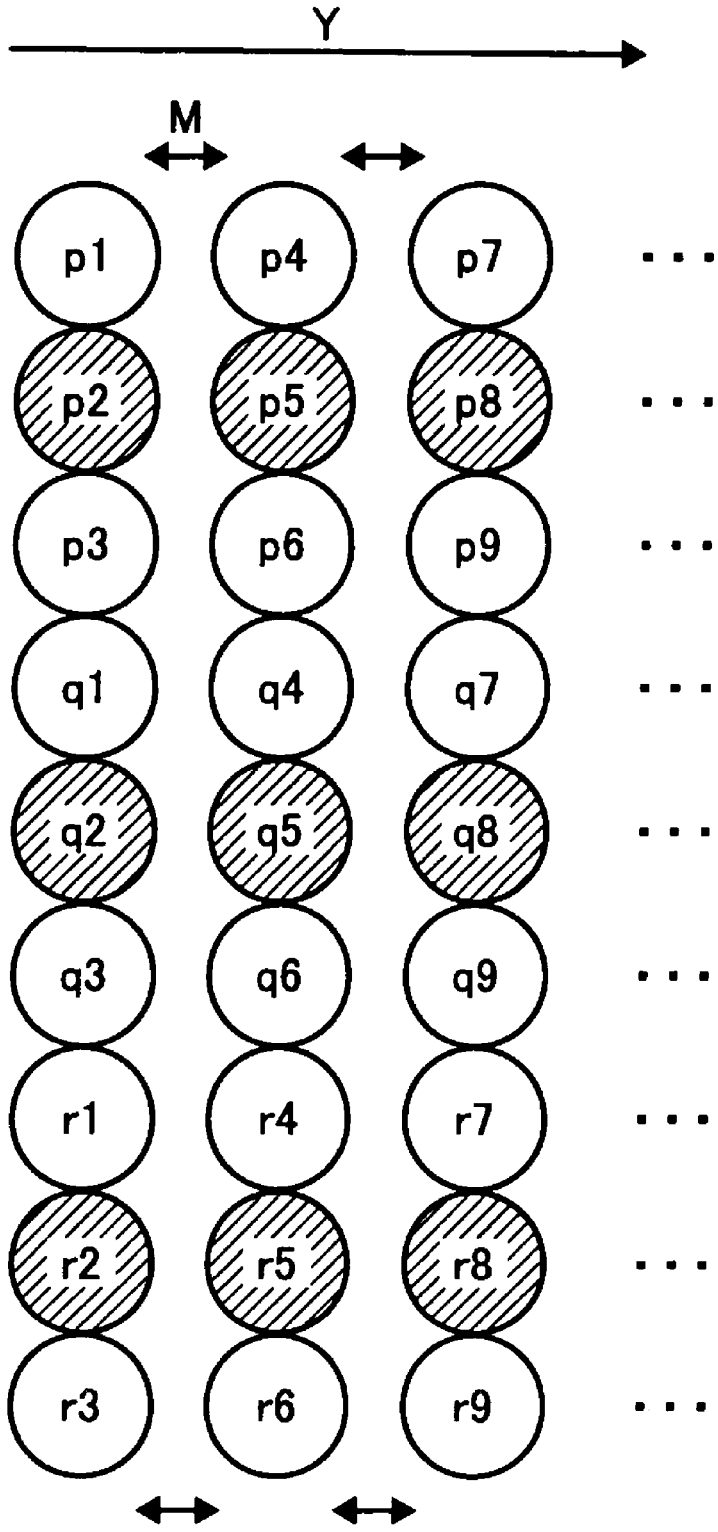
FIG. 11 is a schematic diagram illustrating another ejection result of ink droplets by the inkjet recording apparatus according to another exemplary embodiment.

Next, a liquid recording apparatus according to another exemplary embodiment is described with reference to FIGS. 10 and 11. Similar to the exemplary embodiment of FIGS. 1-9, the liquid recording apparatus according to the exemplary embodiment of FIGS. 10 and 11 is described as a serial-type inkjet recording apparatus. However, the exemplary embodiment of FIGS. 10 and 11 is also applicable to other type liquid recording apparatus including a line-type inkjet recording apparatus.

FIG. 10 is a timing chart illustrating an example of drive signals generated in an inkjet recording apparatus according to said another exemplary embodiment. FIG. 11 is a schematic diagram illustrating an example of ejection result of ink droplets by the inkjet recording apparatus according to said another exemplary embodiment.

Hereinafter, components of the exemplary embodiment of FIGS. 1-9 corresponding to those of the exemplary embodiment of FIGS. 10 and 11 are indicated by identical reference numerals or letters, and redundant descriptions thereof are omitted for simplicity.

As described above with reference to FIG. 7, the recording head unit 14 ejects ink droplets while the voltage of the drive signal "B" is changing. However, the recording head unit 14 may eject ink droplets only while the voltage of the drive signal "B" is increasing or decreasing.

For example, FIG. 10 illustrates an operation of the drive signal "A" in a case in which ink droplets are ejected only while the voltage of the drive signal "B" is increasing. Thus, the recording head unit 14 ejects ink droplets only while moving in a certain direction.

FIG. 11 illustrates an ejection result by the inkjet recording apparatus according to the another exemplary embodiment.

As described above, FIG. 8 illustrates ink droplets having been ejected from the nozzles "H", "I", "J" of the nozzles arranged in the conventional recording head. For example, the conventional recording head sequentially ejects ink droplets h1, h2, h3 from the nozzle "H". Similarly, the conventional recording head sequentially ejects ink droplets i1, i2, i3 from the nozzle "I" and ink droplets j1, j2, j3 from the nozzle "J", respectively.

Similar to the exemplary embodiment of FIG. 1, the inkjet recording apparatus according to the exemplary embodiment of FIGS. 10 and 11 vibrates the recording head unit 14 in a direction perpendicular to the main scanning direction Y. During this vibration, as illustrated in FIG. 11, the recording head unit 14 sequentially ejects ink droplets pl, p2, p3 around the conventional landing position of the ink droplet hl indicated by hatching in FIGS. 8 and 11.

However, in the exemplary embodiment of FIGS. 10 and 11, the recording head unit 14 may eject ink droplets only when moving in a given one direction during this vibration. For example, after a given time has passed since the ejection of the ink droplet p3, the recording head unit 14 sequentially ejects ink droplets p4, p5, p6 onto the sheet 3 as illustrated in FIG. 11. As a result, the ink droplets p4, p5, p6 are formed on the sheet 3 at a distance "M" away from the ink droplets pl, p2, p3, respectively. Such time interval and distance may also suppress bleeding between ink droplets.

Similarly, the recording head unit 14 sequentially ejects ink droplets q1, q2, q3 around the conventional landing position of the ink droplet i1, and ink droplets r1, r2, r3 around the conventional landing position of the ink droplet j1, indicated by hatching in FIGS. 8 and 11.

In the foregoing description, only the three nozzles P, Q, R are referred to as the nozzles of the recording head unit 14. It should be noted, however, that the number of nozzles of the recording head unit 14 is not limited to three and may be more than three or less than three.

Accordingly, compared to a recording head of a conventional inkjet recording apparatus, the recording head unit 14 according to the exemplary embodiment of FIGS. 10 and 11 may also apply ink droplets onto a sheet at a relatively high density while suppressing bleeding, thus enabling the inkjet recording apparatus according to such exemplary embodiment to provide a relatively high-resolution image.

Next, a liquid ejecting apparatus according to still another exemplary embodiment is described. The still another exemplary embodiment is applicable to a line-type recording apparatus as described below.

For example, the line-type recording apparatus may include a full-line recording head having a longitudinal length corresponding to the full length of the main scanning area thereof. While feeding a sheet step-wise in the sub-scanning direction, the line-type recording apparatus uses the full-line recording head to eject ink droplets on the sheet to record an image. While being vibrated, the full-line recording head ejects ink droplets onto the sheet. Thus, the full-line recording head may eject ink droplets onto an area on the sheet, which is deviated from a substantially vertical direction from each nozzle toward the sheet. The area on the sheet corresponds to an interval area between adjacent nozzles of the nozzles arrayed in the full-line recording head.

Accordingly, compared to a conventional recording head, the full-line recording head may apply ink droplets onto a sheet at a relatively high density without increasing the number of nozzles, thereby enabling the line-type recording apparatus according to the still another exemplary embodiment to provide a relatively high-resolution image.

Next, a liquid ejecting apparatus according to a further another exemplary embodiment is described with reference to a serial-type inkjet recording apparatus.

In the inkjet recording apparatus 1 of the above-described exemplary embodiment illustrated in FIG. 1, the driving element 17 is disposed on the side surface 14*a* of the recording head unit 14, which is provided parallel to the main scanning direction thereof.

In the further another exemplary embodiment, another driving element may be disposed on the side surface 14*b* of the recording head unit 14 in addition to the driving element 17 disposed on the side surface 14*a* illustrated in FIG. 1. Such additional driving element allows the recording head unit 14 to be more intensely vibrated. Further, appropriate control of such two driving elements may provide more precise vibration of the recording head unit 14.

As a result, compared to a conventional recording head, the recording head unit 14 may also apply ink droplets onto a sheet in a relatively high density without increasing the number of nozzles, thereby enabling the inkjet recording apparatus according to the further another exemplary embodiment to provide a relatively high-resolution image.

Embodiments of the present application may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. Embodiments of the present application may also be implemented by the preparation of application specific integrated circuits or by interconnecting an appropriate network of conventional component circuits, as will be readily apparent to those skilled in the art.

Numerous additional modifications and variations are possible in light of the above teachings. It is therefore to be understood that, within the scope of the appended claims, the disclosure of this application may be practiced otherwise than as specifically described herein.

Further, elements and/or features of different exemplary embodiments may be combined with each other and/or substituted for each other within the scope of this disclosure and appended claims.

Still further, any one of the above-described and other example features of the present application may be embodied in the form of an apparatus, method, system, computer program or computer program product. For example, the aforementioned methods may be embodied in the form of a system or device, including, but not limited to, any of the structures for performing the methodology illustrated in the drawings.

Even further, any of the aforementioned methods may be embodied in the form of a program. The program may be stored on a computer readable medium and adapted to perform any one of the aforementioned methods when run on a computer device (a device including a processor). Thus, the storage medium or computer readable medium is adapted to store information and is adapted to interact with a data processing facility or computer device to perform the method of any of the above-described embodiments.

The storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetic storage media, including but not limited to floppy disks™, cassette tapes, and removable hard disks; media with a built-in rewriteable non-volatile memory, including but not limited to memory cards; and media with a built-in ROM, including but not limited to ROM cassettes, etc. Furthermore, various information regarding stored images, for example, property information, may be stored in any other form, or provided in other ways.

Exemplary embodiments being thus described, it will be obvious that the same may be varied in many ways. Such variations are not to be regarded as a departure from the spirit and scope of the present application, and all such modifications as would be obvious to one skilled in the art are intended to be included within the scope of the following claims.

The present patent application claims priority under 35 U.S.C. §119 upon Japanese Patent Application No. 2006-

213688 filed on Aug. 4, 2006 in the Japan Patent Office, the entire content of which is hereby incorporated herein by reference.

What is claimed is:

1. A liquid ejecting apparatus, comprising:

a recording head including a nozzle and configured to eject a liquid onto a recording medium through the nozzle;

a vibrator disposed on the recording head and configured to vibrate the recording head in a first direction in which the recording medium is conveyed and in a second direction opposite to the first direction; and a controller configured to control the vibrator to vibrate the recording head in the first direction in which the recording medium is conveyed and in the second direction opposite to the first direction, and to control the recording head to eject the liquid only while the recording head is moving in one given direction selected from (i) the first direction in which the recording medium is conveyed and (ii) the second direction opposite to the first direction.

2. The liquid ejecting apparatus according to claim 1, further comprising a carriage configured to mount the recording head thereon and to move the recording head in another direction different from the first direction in which the recording medium is conveyed, wherein the controller controls the recording head to eject the liquid while moving the carriage in said another direction.

3. The liquid ejecting apparatus according to claim 1, wherein the liquid is ink and the recording head ejects the ink through the nozzle onto the recording medium to record an image.

4. The liquid ejecting apparatus according to claim 1, wherein the recording head includes an array of a plurality of nozzles, and wherein the vibrator is configured to vibrate the recording head so that the liquid is ejected at a given position on the recording medium defined by an interval between adjacent nozzles of the plurality of nozzles. vibrating the recording head and ejecting the liquid.

5. The liquid ejecting apparatus according to claim 1, wherein the recording head ejects the liquid only while the recording head is moving in the one given direction, and does not eject the liquid while the recording head is moving in the other one of (i) the first direction and (ii) the second direction opposite to the first direction.

6. The liquid ejecting apparatus according to claim 1, wherein the controller supplies a first drive signal to cause the recording head to eject the liquid, and supplies a second drive signal to cause a change of an orientation of the nozzle.

7. The liquid ejecting apparatus according to claim 6, wherein the recording head ejects the liquid only when the first drive signal is increasing or only when the first drive signal is decreasing.

8. The liquid ejecting apparatus according to claim 1, wherein the vibrator includes:

a first driving element disposed on a first side surface of the recording head; and a second driving element disposed on a second side surface of the recording head.

9. The liquid ejecting apparatus according to claim 8, wherein each of the first side surface on which the first driving element is disposed and the second side surface on which the second driving element is disposed is parallel to a main scanning direction of the recording head.

10. The liquid ejecting apparatus according to claim 8, wherein the second side surface on which the second driving element is disposed is opposite to the first side surface on which the first driving element is disposed.

11. A method of ejecting liquid for recording information on a recording medium, comprising:

vibrating a recording head in a first direction in which the recording medium is conveyed and in a second direction opposite to the first direction; and ejecting a liquid from the recording head onto the recording medium only while the recording head is moving in a given one direction selected from (i) the first direction in which the recording medium is conveyed and (ii) the second direction opposite to the first direction.

12. The method according to claim 11, further comprising simultaneously vibrating the recording head and ejecting the liquid.

13. A computer program product stored on a computer readable storage medium for causing a computer to execute a method for causing liquid to be ejected to record information on a recording medium, the method comprising:

vibrating a recording head in a first direction in which the recording medium is conveyed and in a second direction opposite to the first direction; and ejecting a liquid from the recording head onto the recording medium only while the recording head is moving in a given one direction selected from (i) the first direction in which the recording medium is conveyed and (ii) the second direction opposite to the first direction.

14. The computer program product according to claim 13, further comprising simultaneously vibrating the recording head and ejecting the liquid.

* * * * *